US006942363B1

(12) United States Patent
LeVasseur

(10) Patent No.: US 6,942,363 B1
(45) Date of Patent: Sep. 13, 2005

(54) METAL HALIDE ACCENT FIXTURE WITH ADJUSTABLE REFLECTOR/BEAM SPREAD

(75) Inventor: Craig LeVasseur, Golden, CO (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 10/290,000

(22) Filed: Nov. 6, 2002

(51) Int. Cl.[7] ..... F21V 17/02; F21V 14/04

(52) U.S. Cl. ..... 362/277; 362/267; 362/285; 362/319

(58) Field of Search ..... 362/187, 188, 362/267, 270, 277, 319, 455, 263–265, 285, 362/372, 416

(56) References Cited

U.S. PATENT DOCUMENTS 3,703,635 A * 11/1972 Burkath ..... 362/265
4,307,439 A * 12/1981 Sassmannshausen ..... 362/188
4,725,932 A * 2/1988 Gammache ..... 362/188
4,729,065 A * 3/1988 Bahnemann et al. ..... 362/285
4,729,077 A * 3/1988 Gordin et al. ..... 362/285
4,777,566 A * 10/1988 Lowell et al. ..... 362/3
4,984,141 A * 1/1991 Lai et al. ..... 362/187
5,083,253 A * 1/1992 Hahnel ..... 362/455
5,630,661 A * 5/1997 Fox ..... 362/187
6,702,452 B2 * 3/2004 Jigamian et al. ..... 362/187

* cited by examiner

*Primary Examiner*—Alan Cariaso
(74) *Attorney, Agent, or Firm*—John E. Wagner; Robert C. Smith

(57) ABSTRACT

A metal halide light fixture includes three generally cylindrical parts including a lamp housing with a lamp and a lamp socket, an intermediate sleeve member secured to the lamp housing, and a third focusing housing secured to the intermediate sleeve member. The focusing housing includes a reflector member including a concave reflecting surface and a lens. The lamp housing carries a T-6 lamp or similar lamp which includes a cylindrical arc tube having a significant axial length. Rotating the focusing housing moves the reflector member which surrounds the lamp axially relative to the arc tube to shift the light output pattern from floodlight to spotlight. The lamp housing is connected to a mounting structure through a swivel connection. Wires from the lamp socket are fed through a port in the lamp housing and a channel in the mounting structure and are potted in place. Threaded connections between the three principal parts are protected by O-ring seals.

19 Claims, 3 Drawing Sheets

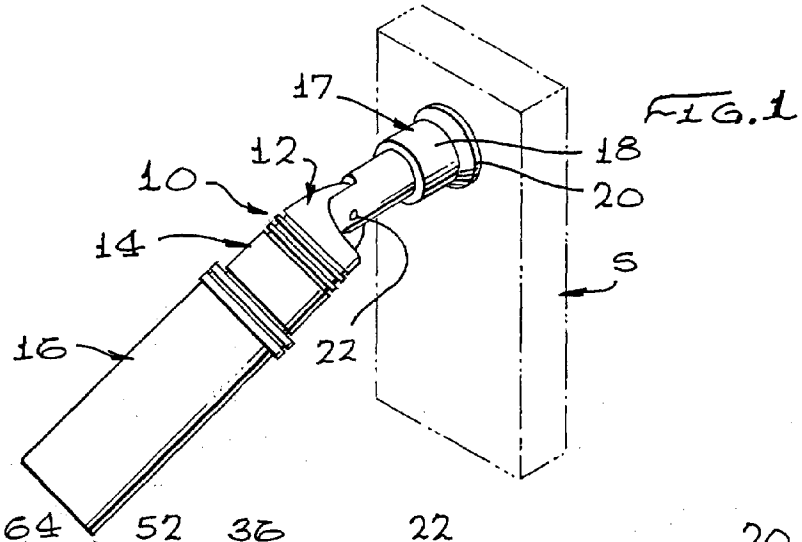
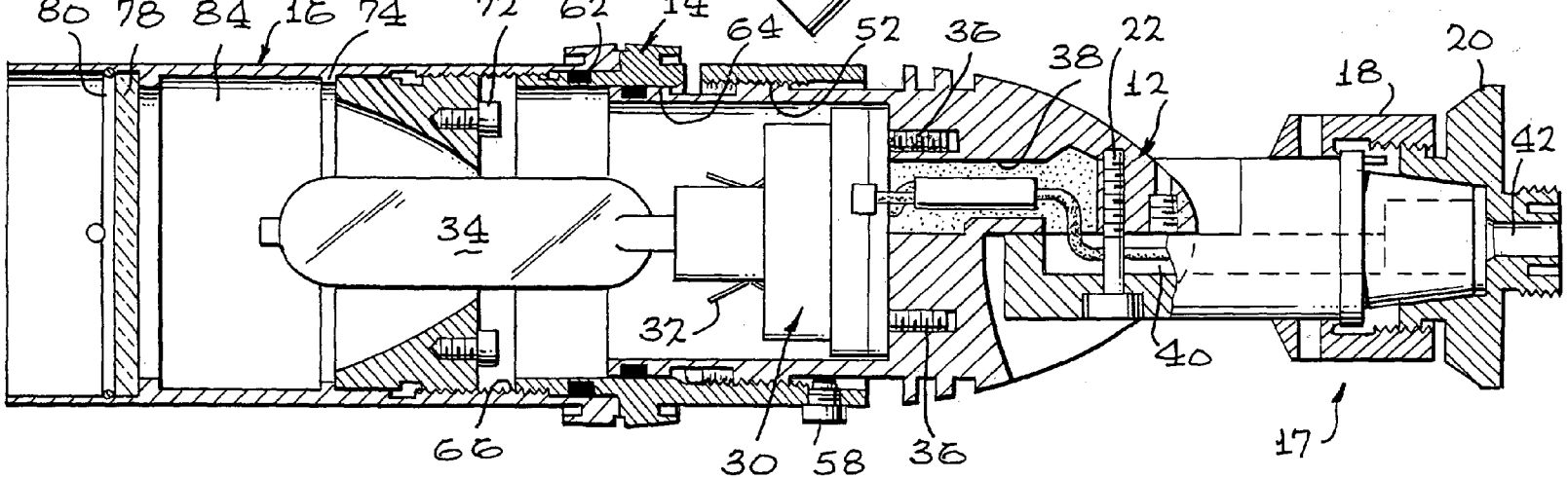
FIG. 3

METAL HALIDE ACCENT FIXTURE WITH ADJUSTABLE REFLECTOR/BEAM SPREAD

BACKGROUND OF THE INVENTION

This invention relates to lighting fixtures, and more importantly to fixtures usable for indoor or outdoor lighting and which are adjustable to provide various beam spreads.

A particular lighting fixture type may need to be adjustable to provide various beam spreads to accomplish a given task; e.g., in one location a fixture may require a wide spread to illuminate a specified area and in another location may require more intense illumination over a smaller area. While fixtures are available with some adjustment in beam spreads, a limited number of beam spreads are available.

There is a need for a low cost, compact, metal halide lighting fixture which is suitably sealed to permit outdoor installation and which is adjustable to provide an infinite range of beam spreads from a spotlight to floodlight, while maintaining a relatively uniform intensity across the beam, particularly without low intensity or dark spots at different beam spreads. Such a lamp should also require lower maintenance than other metal halide lamps presently available.

SUMMARY OF THE INVENTION

The invention described herein comprises a lighting fixture formed of three generally cylindrical threadedly engaged parts, which include a lamp housing, an intermediate sleeve and a focusing sleeve. The lamp housing is connected through a swivel connection to a lamp base or mounting member. Ports are provided in the mounting member and the lamp housing for conducting wires from the lamp base past the swivel connection and the mounting member to an exterior connector.

The lamp housing includes an exterior groove containing an O-ring seal which seals against an internal surface of the intermediate sleeve. At the opposite end of the intermediate sleeve is a groove containing an O-ring seal which seals against a cylindrical internal surface of the focusing sleeve. An elongated lamp, such as a T-6 halide lamp having an axially extending arc tube, is secured in the lamp housing.

The focusing sleeve includes internal threads which engage external threads on the intermediate sleeve. Carried within the focusing sleeve is a reflector member having a generally concave interior surface. A lens is secured to the inside of the focusing sleeve and a light-absorbing layer is secured between the reflector member and the lens. The focusing sleeve includes a groove and two internal ridges, one of which serves as a stop for locating the reflector member and the other which cooperates with a locking ring carried in the groove to secure the lens in place. Turning the focusing sleeve also carries the intermediate sleeve causing the focusing sleeve and the reflector member to move axially with respect to the lamp light source, i.e., arc tube. This causes the light output of the light fixture to change from floodlight to spotlight and vice versa.

This invention utilizes a particular characteristic of standard metal halide lamps to cooperate with the reflector and adjustment mechanism to provide a continuously variable beam spread with relatively uniform light level across the beam from full flood to narrow beam.

The adjustment range of the beam from flood to spot is determined by varying the position of the reflector relative to the elongated arc tube of the lamp. This produces a relatively uniform light level without dark spots across the beam at any position as well as a markedly wide beam spread depending upon the longitudinal adjustment of the apertured reflector.

The elongated metal halide lamp is mounted on the central axis of the fixture and extends through a central aperture of the reflector and the elongated arc tube or light source is positioned on the axis of the lamp. The generally cylindrical light source envelope has a relatively large diameter compared with the size of the reflector. In the usual prior art fixture, the goal is to provide the smallest point source of light captured by the largest practical collector. A typical incandescent auto headlamp, for example, has a very small filament positioned as closely as possible to the focal point of a large, parabolic reflector. In the fixture described herein, the reflector may be conical or somewhat curved, as in a parabola, and its maximum diameter is only about two and one-half times the diameter of the lamp and just slightly over seven times the diameter of the arc tube.

When the fixture is adjusted to the maximum "spotlight" position, the inner edge of the arc tube (that edge closest to the lamp housing) is substantially aligned with the inner edge of the reflector. As the adjusting sleeve is moved toward the "floodlight" position, the reflector is moved rearwardly away from the arc tube until at full floodlight position the arc tube is positioned closer to the outer edge of the reflector (closer to the lens).

One feature of this invention is that the focusing function is performed without opening the housing, rather by merely twisting the focusing sleeve which changes the longitudinal position of the reflector.

Another feature of this invention is that the reflector may be a spun metal or a casting.

Still another feature is the simplicity of the design, which allows lamps of various wattage, e.g. 35 watt or 75 watt, to be produced merely by scaling up or down some of the parts of the fixture.

BRIEF DESCRIPTION OF THE DRAWINGS

This invention may be more clearly understood with the following detailed description and reference to the drawings in which:

FIG. 1 is a perspective view of the lighting fixture of the invention;

FIG. 3 is a sectional view of the assembled lighting fixture of FIGS. 1 and 2;

DETAILED DESCRIPTION

Figure 2:
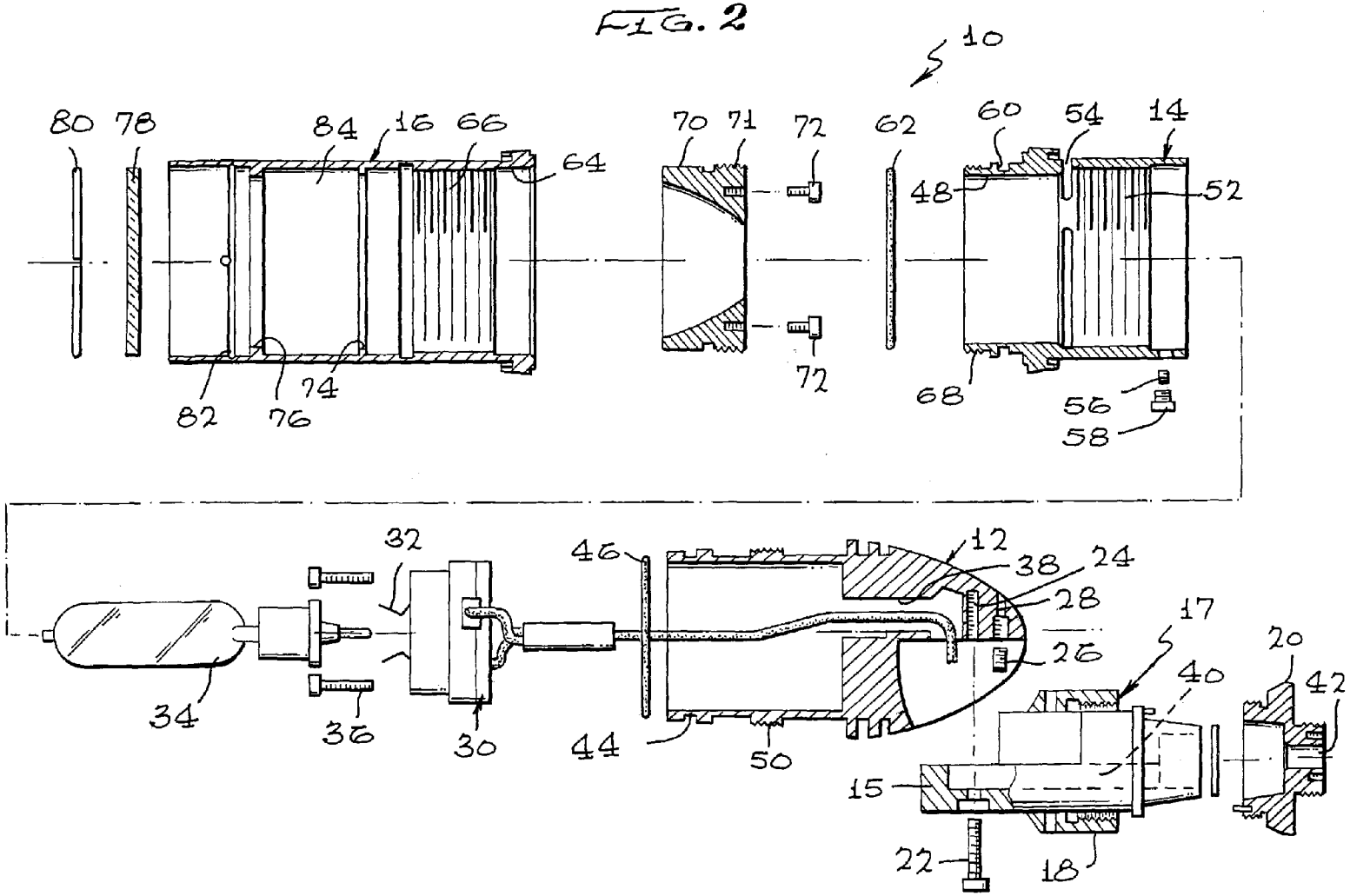
FIG. 2 is an exploded view, in section, of the lighting fixture of FIG. 1.

Referring now to FIG. 1, which is a perspective view of a metal halide lighting fixture 10 according to the invention, fixture 10 includes a lamp housing 12, an intermediate sleeve 14 and a focusing sleeve 16. The lamp housing is secured to a mounting assembly 17 which includes certain parts discussed below, including a flange 20 and a sleeve 18 which is threadedly engaged with flange 20.

FIG. 2 is an exploded longitudinal sectional view of the lighting fixture 10 of FIG. 1; and FIG. 3 is a longitudinal sectional view of the fixture as assembled. In FIGS. 2 and 3 are shown the lamp housing 12, the intermediate sleeve 14, and the focusing sleeve 16. Shown separated from lamp housing 12 in FIG. 2 is a mounting assembly 17, which incorporates a body 15, a sleeve 18 and a flange 20 to provide a swivelable mounting structure for lighting fixture 10. Note that mounting assembly 17 is secured to the cut-out portion at the right end of lamp housing 12 by means of a screw 22 passing through body 15 and secured in threaded port 24. This permits lamp housing 12 to pivot around screw 22. Once the angle between lamp housing 12 and mounting assembly 17 is established, this angle is secured by means of a set screw 26, which is accessible through an opening 28 to engage body 15 to retain the desired angle.

A lamp socket 30 includes spring members 32, which retain a metal halide lamp 34 (in this case a compact T-6 lamp). Lamp socket 30 is secured in lamp housing 12 by means of a pair of screws 36. Wires extending from the lamp socket 30 are fed through a port 38 in lamp housing 12 and from there into and through a channel 40 in body 15 and a port 42 in flange 20. The portions of the wires installed in lamp housing 12 are coiled or bent, and the port 38 is potted to secure the wires in place and to protect them from moisture. The wires are also subjected to an anti-wicking process to further prevent moisture from wicking along the wires to the lamp socket.

Lamp housing 12 includes on its exterior surface a groove 44 which receives an O-ring 46. This O-ring 46 seals against an interior surface 48 of intermediate sleeve 14. Lamp housing 12 also includes external threads 50 which mate with internal threads 52 in intermediate sleeve 14. A plurality (e.g., 3) of openings 54 around the periphery of intermediate sleeve 14 provide "weep holes" permitting moisture to escape from the interior of fixture 10. A set screw 56 having left-hand threads is set in a cap screw 58 threaded into intermediate sleeve 14. Cap screw 58 is turned into intermediate sleeve 14 to force screw 56 against a surface of lamp housing 12 to secure the relative positions of lamp housing 12 and intermediate sleeve 14.

Intermediate sleeve 14 has an external groove 60 which receives an O-ring 62 which seals against a smooth internal surface 64 of focusing sleeve 16. Focusing sleeve 16 also includes internal threads 66, which mate with threads 68 on the external surface of intermediate sleeve 14. A generally concave reflector member 70, which includes external threads 71 mating with threads 66 is positioned within sleeve 16. Lamp 34 extends through an aperture 70*a* in reflector 70. A pair of screws 72, having upstanding heads, are located on one face of reflector member 70 to provide a means for turning reflector member 70 on threads 66. Other irregular surface features may be formed on the right-hand surface of reflector 70 as aids to turning it on threads 66. An internal ridge 74 provides a stop limiting travel of reflector member 70 toward the left. A second internal ridge 76 serves to locate a lens 78, which is secured against ridge 76 by means of a locking ring 80 which seats in a groove 82. A layer of anti-reflection material 84 is secured to an inside surface of focusing sleeve 16 between ridges 74 and 76 to prevent excessive internal reflections. Anti-reflecting paint is preferably applied to the inside surface of focusing sleeve 16 to the left of locking ring 80, as shown in FIG. 3.

Figure 4:
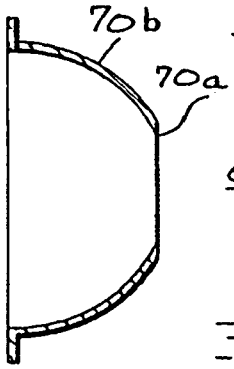
FIG. 4 is a sectional view through an alternate form of reflector member from that shown in FIG. 2.

FIG. 4 is a cross-sectional view of an alternate form of reflector member 70*b* different from member 70 of FIGS. 2 and 3. Member 70 is typically machined from a casting. For many applications, a reflector member 70*b*, which may be of spun aluminum, will be quite adequate and is less expensive to fabricate.

Figure 5:
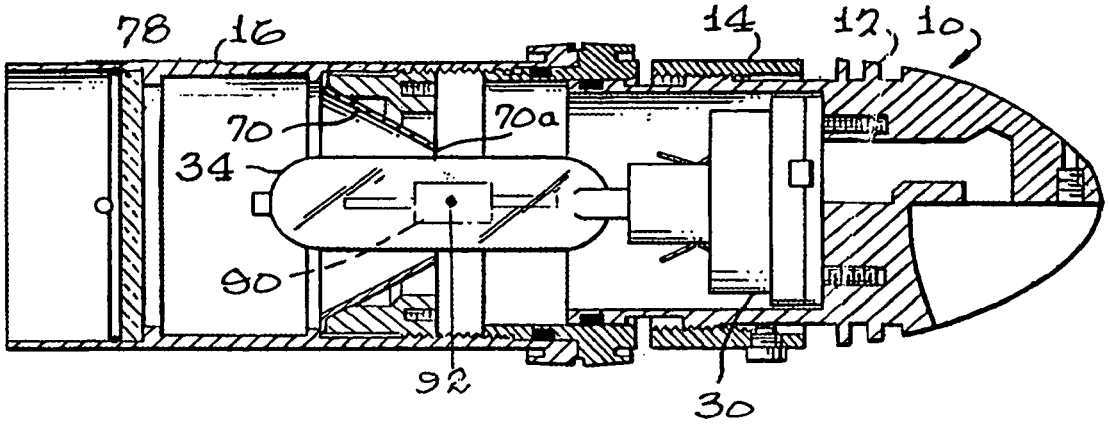
FIG. 5 is an enlarged view of the lighting fixture of FIGS. 1–3 showing a lamp such as a T-6 lamp in relation to a first position of the reflector member.

FIG. 5 is a view, partly in section, of the lighting fixture 10 showing details of lamp 34 in relation to reflector member 70. Reflector member 70, which may be of the type shown in FIG. 4, abuts against ridge 74 and is held against ridge 74 by means of a ring member 71, which is threadedly engaged with threads 66. Lamp 34 includes an elongated light source, an arc tube 90 in which, as shown in FIG. 5, its longitudinal center 92 identified in FIGS. 5 and 6 by a black dot in the center of arc tube 90 is behind aperture 70*a*. Lamp 34 has an elongated clear glass envelope 88 secured to lamp socket 30. Arc tube 90 is in the form of a cylinder of significant diameter and axial length. Focusing of light from lamp 10 from a spot to a floodlight position or vice versa is accomplished by rotating focusing member 16 and intermediate member 14 on threads 52 such that the reflector member 70 moves axially with respect to arc tube 90. Thus with respect to FIG. 5, illumination from arc tube 90 extends radially against reflector 70 and is mostly reflected from reflector 70 as a narrow beam through aperture 70*a* and through lens 78. Other illumination is directed straight through lens 78. In this position, fixture 10 operates as a spotlight.

Figure 6:
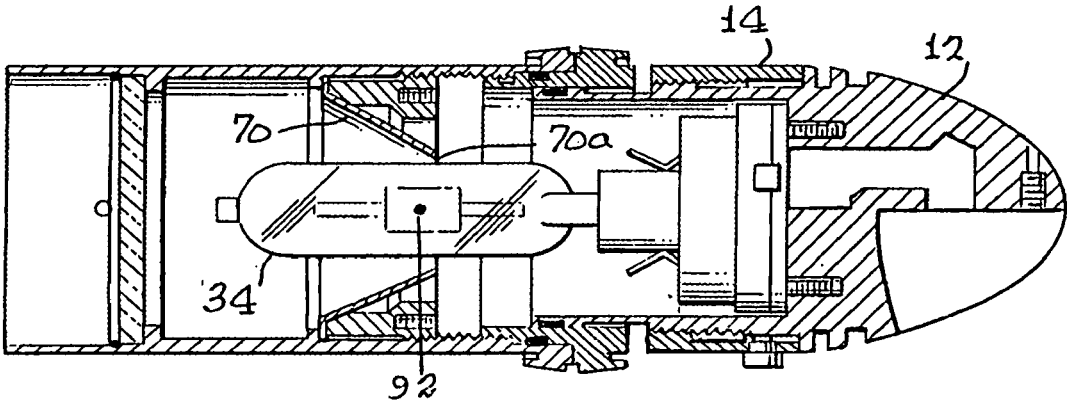
FIG. 6 is a view similar to FIG. 5 showing the lamp in relation to a second position of the reflector member.

FIG. 6 is a view similar to FIG. 5 but showing reflector member 70 or 70*b* in a significantly different position relative to arc tube 90. Focusing member 16 and intermediate sleeve 14 have been rotated such that sleeve 14 has moved rearwardly such that the longitudinal center of arc tube 90 is in front of the aperture 70*a*. The change of relative positions of the two O rings shown as black areas in FIGS. 5 and 6 also illustrates the difference in position of the arc tube 90 between FIGS. 5 and 6. In FIGS. 5 and 6, the longitudinal center 92 of the arc tube 90 is marked by a dot and a vertical lead line. Illumination from arc tube 90 is reflected in several angles or directions from reflector member 70*b* through lens 78, or directed straight through lens 78. When the parts are in the position shown in FIG. 6, fixture 10 operates as a floodlight.

As an example, a Philips 35/T6/830 lamp has an arc tube approximately 0.375 in. long and a diameter of approximately 0.25 in. The glass envelope 88 is approximately 0.75 in. in diameter. The maximum diameter of reflector 70*b* is 1.805 in., and the diameter of the aperture is 0.842 in.

Figure 7A:
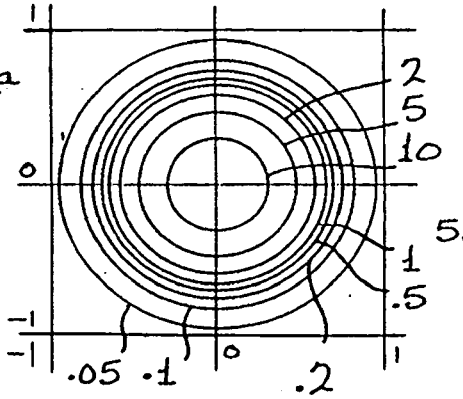
FIGS. 7A and 7B are graphs showing the change in illumination patterns of the lighting fixture of the invention from the full spotlight position to the full floodlight position.
Figure 7B:
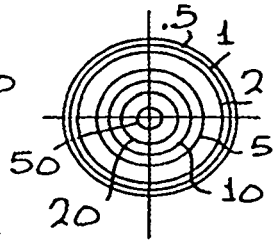

FIGS. 7A and 7B are graphs showing typical lighting patterns of fixture 10 in floodlight and spotlight positions, respectively, as projected on a grid. Although both patterns show a reduction in light intensity toward the outside edges, both the floodlight pattern and the spotlight pattern are complete and clean without the usual dark spots which are commonly seen in the light patterns of adjustable beam illuminators using lamps with transverse filaments, such as flashlights. More details relative to illumination patterns of fixture 10 are described in the report of Luminaire Testing Laboratory, Inc. attached as an Appendix at the back of the present application.

The above-described embodiments of the present invention are merely descriptive of its principles and are not to be considered limiting. The scope of the present invention instead shall be determined from the scope of the following claims including their equivalents.

I claim:

1. A lighting fixture consisting of a generally cylindrical housing having a longitudinal axis and a front light-emitting opening, an elongated lamp in said housing having an axially extending light source;

a generally cylindrical member axially adjustable with respect to said lamp and a single apertured reflector member mounted in said generally cylindrical member surrounding said lamp, said reflector member surrounding and being coaxial with said axially extending light source, said reflector including a generally concave reflecting surface; and means for varying the relative axial positions of said light source and said single reflector member from a position where the longitudinal center of said axially extending light source is moved from positions substantially behind to substantially ahead of the aperture in said apertured reflector to change the beam size from spot to floodlight produced by said lighting fixture through said front light-emitting opening.

2. A lighting fixture as claimed in claim 1 wherein said reflector member has an aperture along its axis and said lamp extends variably through said aperture.

3. A lighting fixture comprising a lamp housing and an elongated lamp in said lamp housing, said lamp having a longitudinally extending light source;

and a focusing member having a cylindrical internal surface, a lens and a concave reflector member including an aperture surrounding said lamp, one of said focusing member and said longitudinally extending light source in said lamp being movable from a position substantially behind said aperture to a position substantially in front of said aperture to vary the beam spread of said lighting fixture; and wherein said reflector member is coaxial with the longitudinally extending light source portion of said lamp.

4. A lighting fixture as claimed in claim 3 wherein said reflector member is adjustable relative to said light source between a position where the longitudinal center of said light source is substantially behind said aperture, and light radiating from said light source is projected through said lens as a narrow beam and a position where the longitudinal center of said light source is ahead of said aperture and light projected through said lens is spread.

5. A lighting fixture as claimed in claim 3 wherein anti-reflecting material is secured to a portion of said cylindrical internal surface.

6. A lighting fixture comprising a lamp housing, threads and a first seal on an external surface of said housing, and an elongated generally cylindrical lamp in said housing having an axis and an elongated axially extending arc tube;

a generally cylindrical member threadedly engaged with said lamp housing having an internal surface engaging said seal and an external surface including a second seal and external threads; and a focusing member operatively connected to said lamp housing and having a cylindrical internal surface in contact with said second seal, a lens and a reflector member, said focusing member and said reflector member being axially adjustable with respect to said arc tube to vary the beam spread of said lighting fixture.

7. A lighting fixture as claimed in claim 6 wherein said reflector member has a concave reflecting surface and has an aperture positioned along the axis of said lamp, said lamp extends through said aperture, and said reflector member is adjustable between a position where light radiating from said arc tube is projected through said lens as a narrow beam and a second position where said aperture is spaced from said arc tube and light projected through said lens is spread.

8. A lighting fixture as claimed in claim 6 wherein said reflector member includes an aperture extending along the axis of said lamp and said lamp extends through said aperture.

9. A lighting fixture as claimed in claim 8 wherein said reflector member is adjustable relative to said arc tube between a position where the longitudinal center of said arc is substantially behind said aperture and light radiating from said arc tube is projected through said lens as a narrow beam and a position where the longitudinal center of said arc tube is positioned in front of said aperture and light projected through said lens is spread.

10. A lighting fixture comprising a lamp housing, threads and a first seal on an external surface of said housing, and an elongated generally cylindrical lamp in said housing having an axis and an elongated axially extending arc tube;

a generally cylindrical member threadedly engaged with said lamp housing having an internal surface engaging said seal and an external surface including a second seal and external threads; and a focusing member operatively connected to said lamp housing and having a cylindrical internal surface in contact with said second seal, a lens and a reflector member, said focusing member and said reflector member being axially adjustable with respect to said arc tube to vary the beam spread of said lighting fixture;

further comprising wires connected to said lamp and said lamp housing includes a channel for receiving said wires; and a mounting member includes an axially directed channel for receiving said wires, said wires extend through said channels and said wires are potted throughout at least a portion of the length of one of said channels.

11. A lighting fixture comprising a lamp housing, threads and a first seal on an external surface of said housing, and an elongated generally cylindrical lamp in said housing having an axis and an elongated axially extending arc tube;

a generally cylindrical member threadedly engaged with said lamp housing having an internal surface engaging said seal and an external surface including a second seal and external threads; and a focusing member operatively connected to said lamp housing and having a cylindrical internal surface in contact with said second seal, a lens and a reflector member, said focusing member and said reflector member being axially adjustable with respect to said arc tube to vary the beam spread of said lighting fixture;

further comprising a mounting assembly including a body, a sleeve movable on said body, a flange threadedly engaged with said sleeve, a port through said body, and a screw passing through said port and threadedly engaged with said lamp housing to provide a pivotable connection between said mounting assembly and said lamp housing.

12. A lighting fixture comprising a lamp housing having a generally cylindrical external surface, a generally cylindrical lamp in said lamp housing having an elongated axially extending arc tube, and a first seal on said external surface;

a generally cylindrical member threadedly engaged with said lamp housing having an internal surface engaging said seal and an external surface including a second seal and external threads;

a third member threadedly engaged with said generally cylindrical member and having a cylindrical internal surface in contact with said second seal, a lens, securing means holding said lens in said third member, and a reflector member having a generally concave reflecting surface, said third member and said generally cylindrical member being rotatable relative to said lamp housing, whereby said reflector member is axially movable relative to said arc tube to adjust the beam spread of said fixture.

13. A lighting fixture as claimed in claim 12 wherein said reflector member is threadedly engaged with said third member, said reflector member has a concave reflecting face and includes means defining an irregular surface on one face thereof as an aid to turning said reflector member in said third member.

14. A lighting fixture comprising a lamp housing having a generally cylindrical external surface, a generally cylindrical lamp in said lamp housing having an elongated axially extending arc tube, and a first seal on said external surface;

a generally cylindrical member threadedly engaged with said lamp housing having an internal surface engaging said seal and an external surface including a second seal and external threads;

a third member threadedly engaged with said generally cylindrical member and having a cylindrical internal surface in contact with said second seal, a lens, securing means holding said lens in said third member, and a reflector member having a generally concave reflecting surface, said third member and said generally cylindrical member being rotatable relative to said lamp housing, whereby said reflector member is axially movable relative to said arc tube to adjust the beam spread of said fixture;

wherein said reflector member is threadedly engaged with said third member, said reflector member has a concave reflecting face and includes means defining an irregular surface on one face thereof as an aid to turning said reflector member in said third member; and wherein said fixture includes a mounting assembly, a lamp socket in said lamp housing and wires connected to said lamp socket, said mounting assembly includes an axially directed channel for receiving said wires, said wires extend through said channel and said wires are potted throughout a substantial portion of the length of said channel.

15. A lighting fixture as claimed in claim 12 wherein said generally cylindrical member includes at least one slot extending over part of its circumference.

16. A lighting fixture as claimed in claim 12 wherein said securing means comprises an annular ridge and an annular groove in said cylindrical internal surface, a locking ring in said groove, and said lens is secured between said annular ridge and said locking ring.

17. A lighting fixture as claimed in claim 12 wherein anti-reflecting material is secured to a portion of said cylindrical internal surface.

18. A generally cylindrical lighting fixture including a lamp housing, a generally cylindrical lamp in said lamp housing having a longitudinal arc tube extending along the axis of said lamp; and a focusing member operatively connected to said lamp housing including a lens and a reflector member surrounding said lamp having a generally concave reflecting surface, said focusing member being axially movable relative to said lamp arc tube to vary the beam spread of said lighting fixture;

wherein said reflector member is adjustable relative to said arc tube between a position where the longitudinal center of said arc tube is behind said aperture and light radiating from said arc tube is projected through said lens as a narrow beam and a position where the longitudinal center of said arc tube is in front of said aperture and light projected through said lens is spread.

19. A lighting fixture as claimed in claim 18 wherein said reflector member includes an aperture extending along the axis of said lamp and said lamp extends through said aperture.

* * * * *